US009284494B2

(12) United States Patent
Bauer et al.

(10) Patent No.: US 9,284,494 B2
(45) Date of Patent: Mar. 15, 2016

(54) SOLIDS MANAGEMENT IN SLURRY HYDROPROCESSING

(75) Inventors: Lorenz J. Bauer, Schaumburg, IL (US); Tom N. Kalnes, LaGrange, IL (US); James F. McGehee, Mt. Prospect, IL (US)

(73) Assignee: UOP LLC, Des Plaines, IL (US)

( * ) Notice: Subject to any disclaimer, the term of this patent is extended or adjusted under 35 U.S.C. 154(b) by 1522 days.

(21) Appl. No.: 12/271,857

(22) Filed: Nov. 15, 2008

(65) Prior Publication Data

US 2010/0122939 A1 May 20, 2010

(51) Int. Cl.

| | |
|---|---|
| ***C10G 67/04*** | (2006.01) |
| ***C10G 47/26*** | (2006.01) |
| ***C10G 67/02*** | (2006.01) |

(52) U.S. Cl.

CPC ..... *C10G 47/26* (2013.01); *C10G 67/02* (2013.01)

(58) Field of Classification Search

CPC .... C10G 67/0454; C10G 67/04; C10G 47/26; C10G 21/003

USPC ..... 208/86, 309

See application file for complete search history.

(56) References Cited

U.S. PATENT DOCUMENTS

| | | | | | |
|---|---|---|---|---|---|
| 2,715,603 | A | * | 8/1955 | Lanning et al. | 208/96 |
| 3,364,134 | A | * | 1/1968 | Hamblin | 208/93 |
| 3,617,503 | A | * | 11/1971 | Rogers et al. | 208/97 |
| 3,622,503 | A | * | 11/1971 | Hausler | 208/215 |
| 3,996,015 | A | | 12/1976 | Hutchings | 23/288 R |
| 4,354,922 | A | * | 10/1982 | Derbyshire et al. | 208/86 |
| 4,888,108 | A | | 12/1989 | Farnaud | 208/424 |
| 4,952,306 | A | | 8/1990 | Sawyer et al. | 208/216 R |
| 4,994,175 | A | | 2/1991 | Hargreaves et al. | 208/424 |
| 5,298,152 | A | | 3/1994 | Kramer | 208/108 |
| 5,474,977 | A | | 12/1995 | Gatsis | 502/172 |
| 5,599,439 | A | * | 2/1997 | Collins et al. | 208/89 |
| 5,871,634 | A | * | 2/1999 | Wiehe et al. | 208/48 R |
| 6,090,272 | A | * | 7/2000 | Drake et al. | 208/138 |
| 6,171,471 | B1 | | 1/2001 | Ferrughelli et al. | 208/96 |
| 6,274,030 | B1 | * | 8/2001 | Wallace et al. | 208/45 |
| 6,511,937 | B1 | | 1/2003 | Bearden, Jr. et al. | 502/180 |
| 6,660,157 | B2 | | 12/2003 | Que et al. | 208/108 |
| 7,390,398 | B2 | | 6/2008 | Farshid et al. | 208/413 |
| 2002/0112987 | A1 | | 8/2002 | Hou et al. | 208/108 |
| 2005/0241992 | A1 | | 11/2005 | Lott et al. | 208/108 |
| 2007/0138059 | A1 | | 6/2007 | Farshid et al. | 208/57 |

(Continued)

OTHER PUBLICATIONS

Wang, J.Q. et al. "Solvent Processing Technology for Slurry-Bed Hydrocracking Bottom Oil of Karamay Residue," *Journal of the University of Petroleum, China* (Natural Science Edition) 28(1) 2004 p. VIII 92-94; Language: Chinese, Abstract only.

(Continued)

*Primary Examiner* — Michelle Stein

(74) *Attorney, Agent, or Firm* — James C. Paschall

(57) ABSTRACT

The recovery of solids, and particularly solid particulates used as catalysts in slurry hydroprocessing, from asphaltene containing hydrocarbons is improved by controlling asphaltene precipitation. The formation of agglomerates of the solid particulates, having an increased diameter, results in the presence of precipitated asphaltenes, possibly due to flocculation. Asphaltene precipitation is controlled by varying process parameters or introducing additional diluent or flush streams that change the polarity of an asphaltene containing liquid product recovered from an effluent of a slurry hydroprocessing reaction zone.

18 Claims, 1 Drawing Sheet

(56) References Cited

U.S. PATENT DOCUMENTS

| | | | | |
|---|---|---|---|---|
| 2008/0093260 | A1* | 4/2008 | Koseoglu | 208/45 |
| 2008/0099379 | A1 | 5/2008 | Ramamurthy | 208/390 |

OTHER PUBLICATIONS

Stelzer, R. H. et al., "Upgrading of High Metals Boscan, [Venezuela], Residuum Via Co-Processing with Nova Scotia Bituminous Coal," *UNITAR "Heavy Crude and Tar Sands" 6th Int. Conf.* (Houston 2/12-17/95) *Proceedings* V2 277-83 (1995).

Dunn, James A. et al. "Recycle of Vanadium and Nickel-Based Catalysts in a Hydroconversion Process", *Energy and Fuels*, v 17, n 1, Jan./Feb. 2003, p. 38-45 American Chemical Society.

Dickenson, F.E. et al. "Refiner Options for Converting and Utilizing Heavy Fuel Oil", *KFUPM Research Institute 6th Annual Catalysts in Petroleum Refining and Petrochemicals Workshop* (Dhahran, Audi Arabia 12/1-3/96) *Hydrocarbon Processing* (ISSN 0018-8190) V76 N.2 57-60,62 (Feb. 1997) Gulf Publishing Co.

Waugh, W. B. et al. "Advanced Hydroprocessing of Heavy Oil and Refinery Residues", *CANMET: Petro-Canada*; Unocal Corp Source: *13th World Petroleum Congress* (Buenos Aires 1991) Preprint (ISSN 0084-2176) N. 18. 4 8 pp. Applied Science Publishers.

Mariam, H. et al. "Waste Minimization for Selected Residuals in the Petroleum Refining Industry", *NPRA 1996 Environmental Conference* (San Antonio 9/15-17/96) Paper N.ENV-96-165 55 pp.

Haizmann, Robert S. et al. "Integrated Slurry Hydrocracking and Coking Process" pending U.S. Appl. No. 12/271,851, filed Nov. 15, 2008.

Zimmerman, Paul R. et al. "Coking of Gas Oil from Slurry Hydrocracking"; pending U.S. Appl. No. 12/271,880, filed Nov. 15, 2008.

Haizmann, Robert S. et al. "Integrated Solvent Deasphalting and Slurry Hydrocracking Process", pending U.S. Appl. No. 12/271,861, filed Nov. 15, 2008.

* cited by examiner

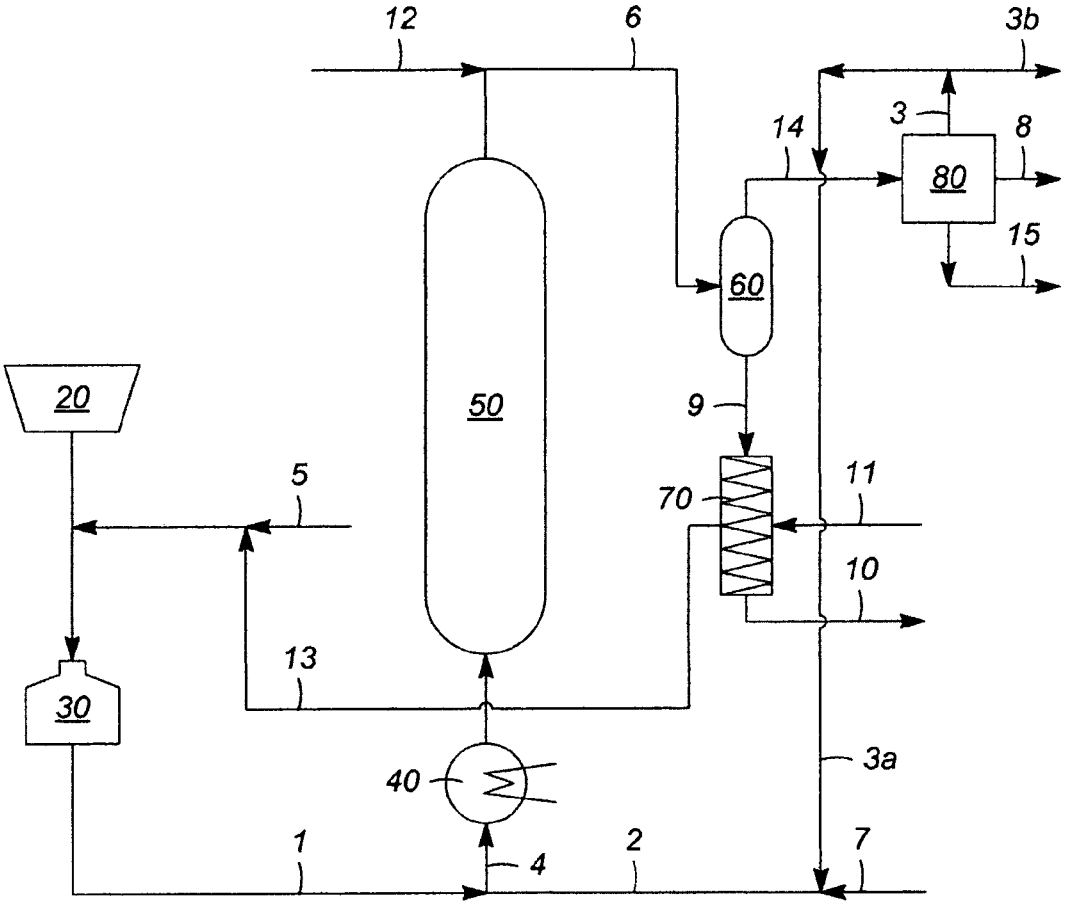
12
6
3b
3
14
8
80
15
60
20
50
9
5
70
11
10
13
30
3a
40
1
4
2
7

SOLIDS MANAGEMENT IN SLURRY HYDROPROCESSING

FIELD OF THE INVENTION

The present invention relates to methods for slurry hydroprocessing in which a heavy hydrocarbon/solid particulate slurry, after passing through a reaction zone, is sent to a recovery section for separating products and filtering the solid particulate (e.g., for recycle to the reaction zone).

DESCRIPTION OF RELATED ART

Slurry hydroprocessing generally refers to the conversion of heavy hydrocarbon feedstocks in the presence of hydrogen and solid catalyst particles (e.g., as a particulate metallic compound such as a metal sulfide) in a slurry phase. Representative slurry hydrocracking processes are described, for example, in U.S. Pat. No. 5,755,955 and U.S. Pat. No. 5,474,977. These processes are normally used to upgrade heavy hydrocarbon fractions by removing contaminants (e.g., sulfur and nitrogen compounds or metals) and/or converting these feedstocks to lower-boiling, higher-value products such as distillates and transportation fuels. Hydrocarbon streams upgraded using slurry hydroprocessing are often obtained from crude oil atmospheric and vacuum distillation, or are otherwise obtained as heavy boiling streams generated in thermal or catalytic conversion processes, with representative examples being heavy cycle oils or slurry oil from fluid catalytic cracking (FCC).

Other sources of heavy hydrocarbons include bitumen and the products of coal liquefaction as described, for example, by Brandes, S. D. et al., Exploratory Research on Novel Coal Liquefaction Concept, *Task 2—Evaluation of Process Steps Topical Report*, U.S. Department of Energy Contract No. DE-AC22-95PC95050 (May 1997). Bitumen is an increasingly important resource for synthetic crude oil manufacture. This low-quality hydrocarbonaceous material is recovered from oil sand deposits, such as those found in the vast Athabasca region of Alberta, Canada, as well as in Venezuela and the United States. Bitumen is recognized as a valuable source of "semi-solid" petroleum, which can be refined into many valuable end products including naphtha or even petrochemicals.

The upgrading of such heavy hydrocarbon feedstocks using slurry hydroprocessing has long been considered, but commercialization efforts have been unsuccessful to date. A significant, remaining obstacle is the difficulty in effectively managing the solids (both catalytic and non-catalytic) contained in the slurry hydroprocessing reactor effluent. While filtration has been proposed and studied, the problem of filter plugging has hampered its practical implementation in the recovery and recycle of solid catalyst particles. Agents that cause filter plugging include the fine catalyst particles as well as solid or highly viscous, hydrocarbon reaction byproducts such as low-value tars and pitch.

Many if not all heavy hydrocarbon feedstocks used in slurry hydroprocessing contain asphaltenes, which are polycondensed aromatic compounds containing oxygen, nitrogen, and sulfur heteroatoms, as well as heavy metals such as nickel and vanadium. Asphaltenes are defined as being insoluble in non-polar aliphatic hydrocarbons such as n-heptane but soluble in aromatic hydrocarbons such as toluene. The deleterious nature of asphaltenes in terms of their tendency to form insoluble coke within refinery equipment such as heat exchangers and furnace tubes is well documented and described, for example, in U.S. Pat. No. 5,997,723. This patent discloses a method for blending asphaltene containing oils with the objective of avoiding asphaltene precipitation caused by "incompatible" or "nearly incompatible" oils that form a blended material with a sufficiently reduced asphaltene solubilizing capability, such that asphaltene precipitation occurs spontaneously from a thermodynamic standpoint.

There is an ongoing need in the art for processes in which heavy hydrocarbons, such as atmospheric column and vacuum column resids as well as gas oils, can be converted or upgraded using slurry hydroprocessing in an economically feasible manner. The successful implementation of such a process depends highly on the effectiveness of a solid/liquid separation, such as filtration, that is performed on the hydroprocessing reactor effluent. There is further a need for overall crude oil refining processes that implement the upgrading of crude oil or synthetic oil residues using slurry hydroprocessing with improved efficiency.

SUMMARY OF THE INVENTION

Aspects of the invention relate to the finding that the recovery, and possible recycle, of solid particulates contained in liquid slurries may be substantially facilitated by the monitoring and control of asphaltene precipitation. In particular, it has now been discovered that the efficiency of solid particulate filtration from an asphaltene containing hydrocarbon, such as a liquid product recovered from a slurry hydroprocessing effluent, can be greatly improved by promoting the precipitation of asphaltenes. This is achieved when the solvent characteristics (i.e., the asphaltene solubilizing capability) of the liquid product are such that asphaltenes precipitate spontaneously, and preferably are such that asphaltene precipitation is highly favored thermodynamically (if not kinetically), according to a solvent parameter (i.e., the solvent blending number:insolubility number ratio) known in the art for characterizing the asphaltene solubilizing capability of liquid hydrocarbons. Without being bound by theory, the surprising observation that asphaltene precipitation improves solid filtration efficiency is believed to result from the ability of precipitated asphaltenes to function as a flocculant or "glue" to bridge or agglomerate solid particulate together into larger agglomerates (i.e., clumps or flocs), thereby facilitating their separation by filtration, often with relaxed operating constraints on the filter or filtration device (e.g., in terms of requiring effective filtration of only the larger agglomerates rather than the smaller solid particulate).

Therefore, with all other variables constant, solid particulate filtration from an asphaltene containing hydrocarbon is considerably improved when at least some of the asphaltene content is itself in solid form (i.e., precipitated), relative to the corresponding case in which all or a larger portion of the asphaltenes are dissolved in the liquid fraction of a slurry. Advantageously, in the presence of precipitated asphaltenes, a filter having a considerably larger pore size, compared to the average particle size of the solid particulate, can recover the solid particulate in the retentate. In contrast, filtration efficiency is greatly compromised when a comparatively greater portion, or even all, of the asphaltenes are solubilized and/or present in a liquid phase (e.g., as a viscous, tar-like, or gummy material) that can exacerbate filter plugging problems. Advantages associated with the present invention therefore include eliminating the formation of such "tar/char" phases during filtration, by promoting asphaltene precipitation.

The present invention is therefore associated with the discovery that agglomeration (sticking or clumping) of fine particles of catalyst to form a large mass is facilitated in the presence of hydrocarbons at or near their solubility limit and/or melting point. This finding was surprising in view of known problems associated with the filtration of liquids containing such hydrocarbons. In particular, as the above-noted solvent parameter is increased, the types of compounds at their solubility limit have directionally higher molecular weights and greater polarity. These more polar compounds include multi-ring and/or heteroatomic (e.g., sulfur- or nitrogen-containing) aromatic compounds, with the melting points of such compounds generally increasing strongly as a function of the number of rings. For example, Rappaport (*CRC Handbook of Tables for Organic Compound Identification*) reports the following approximate melting points for pure aromatic compounds: 9-methylanthracene, 82° C. (180° F.); 9-methylphenanthrene, 91° C. (196° F.); phenanthrene 96° C. (205° F.); 5-methylchrysene 117° C. (243° F.); pyrene 150° C. (302° F.). These and other organic compounds near or slightly above their melting points tend to form a viscous, semi-solid material. The filtration characteristics of such molten, high-viscosity fluids are thought to be poor, requiring large filtration surface areas and high pressure drops. See, for example, Journal Fibre Chemistry (July 1994), 25(4), Springer New York (ISSN 0015-0541). Moreover, the high temperatures required to lower viscosity, for example to a level normally considered acceptable for filtration, increase filter material costs and generally do not provide an economically attractive solution. Despite these drawbacks, it has now been determined that solid particulates may be effectively filtered under conditions of temperature/viscosity and solubility that were previously considered prohibitive.

These and other aspects and embodiments relating to the present invention are apparent from the following Detailed Description.

BRIEF DESCRIPTION OF THE DRAWING

FIG. 1 depicts a representative process involving slurry hydroprocessing, together with solids recovery and recycle, as described herein.

DETAILED DESCRIPTION

Embodiments of the invention therefore exploit the ability of precipitated asphaltenes to flocculate solid particulates and thereby improve solid particulate filtration efficiency. Asphaltene precipitation may be controlled through a number of possible operating conditions, alone or in combination, which affect the solvent characteristics, and particularly the solvent parameter known as the solvent blending number: insolubility number ratio, of the liquid from which separation of the solid particulate is desired. For example, the composition of the liquid may be altered to contain a relatively greater amount of slightly polar or non-polar hydrocarbons, rendering it a relatively poorer asphaltene solvent. In the case of slurry hydroprocessing, changing the conditions (pressure and/or temperature) of the separation used to recover the liquid product, which is ultimately filtered to retain the solid particulate, from the reactor effluent can cause a desired composition change that results in asphaltene precipitation.

For example, higher separation pressures and lower separation temperatures directionally lead to increased quantities of non-polar or slightly polar, lower-boiling hydrocarbons (e.g., $C_4$-$C_7$ aliphatic hydrocarbons generated by hydrocracking reactions) in the liquid product, decreasing its solvent blending number:insolubility number ratio and thereby increasing its tendency to precipitate asphaltenes. Alternatively, increasing conversion in the slurry hydroprocessing reaction zone can provide a slurry effluent, and consequently a liquid product recovered from this effluent, with a relatively higher content of low polarity aliphatic hydrocarbons as hydrocracked products. Otherwise, non-polar or slightly polar compounds (e.g., having a dipole moment of less than half, or less than about 25%, of that of water) may be added as diluents of the liquid product to reduce its asphaltene solubilizing capability. A combination of process adjustments affecting conversion in the hydroprocessing reaction zone and/or the downstream separation (e.g., in a single-stage or flash, high pressure separator) can be used to alter the composition of the recovered liquid product and consequently its solvent parameter (i.e., solvent blending number:insolubility number ratio).

Diluent addition in slurry hydroprocessing may occur upstream of the separator used to recover the liquid product, combined with the solid particulate, from the slurry effluent. Otherwise, diluent may be added to the separator itself, to the liquid product (obtained as the higher-boiling or bottoms fraction from this separator), or to other points in the process. According to another embodiment, the diluent is added to the hot slurry effluent exiting the slurry hydroprocessing reaction zone, thereby additionally serving as a quench material to rapidly reduce the effluent temperature and stop further reactions. A single diluent addition point or a combination of diluent addition points may be used, with the main consideration being control of the composition of the liquid product and consequently its asphaltene solubilizing capability. Suitable diluents for decreasing the solvent parameter of the liquid product include asphaltene "non-solvents" such as aliphatic hydrocarbons and particularly linear $C_4$-$C_7$ alkanes.

While diluents may be used (e.g., alone or in combination with operating condition adjustments, as discussed above) to promote asphaltene precipitation in the liquid product containing a solid particulate, other additives may be used for the opposite purpose, namely to promote asphaltene dissolution. This may be desirable, for example, for flushing the filter to remove accumulated solid retentate (e.g., precipitated asphaltenes and solid particulate) to restore or maintain its function. A flush liquid capable of combining with the liquid product to increase its solvent parameter may be used for this purpose. Suitable flush liquids can be added in slurry hydroprocessing at various points as discussed above with respect to diluents, or may be added to the filter or filtration device itself, as discussed below. Representative flush liquids include refinery process streams having a high content of aromatics, which are capable of solubilizing precipitated asphaltenes.

According to one embodiment, therefore, a flush liquid may be added continuously or discontinuously (intermittently or periodically) in slurry hydroprocessing, as needed to clean, flush, and/or regenerate the filter by solubilizing asphaltenes in the solid retentate. A continuous filtering and flushing operation involves "cross-filtration" to continuously generate a filtered liquid product and a flush effluent slurry containing dissolved asphaltenes and the solid particulate. In a discontinuous filtering operation (e.g., in "dead-end" filtration), flush liquid addition may be preceded by stopping the normal flow of the slurry, comprising the liquid product and solid particulate, to the filter in use. Periodic exchange between or among two or more filters may be employed, with each filter having the capability to be placed "on line" (i.e., for active filtration service) or "off line" (i.e., for regeneration or flushing) with these operating modes being switched as necessary (i.e., in a "swing-mode" of operation) as necessary to maintain at least one filter in active filtration service. In this type of system, it is often desired to "backflush" the retentate (retained fraction of solid particulate and precipitated asphaltenes) from the spent filter with the flush liquid, in the opposite direction of flow, relative to normal filtration service. In any type of filtration, the generated, flush effluent slurry (i.e., the combination of flush liquid with removed filter retentate) may then be recycled to the slurry hydroprocessing reaction zone for reuse of the solid particulate (e.g., as hydroprocessing catalyst).

According to another embodiment, the flush liquid is added intermittently or periodically without stopping flow of the liquid product to the filter or removing the filter from its normal filtration service in the process flowscheme. In this type of operation, the flush liquid effectively alters the liquid product composition by increasing its solvent parameter (i.e., solubility blending number:insolubility number ratio), such that asphaltenes retained on the filter become dissolved and their flocculent capability disrupted. This causes the retained fraction of solid particulate and asphaltenes to pass through the filter, until the filter is flushed and the liquid product composition and its solvent parameter are restored (e.g., by stopping flow of the flush liquid), thereby again precipitating asphaltenes. In this mode of operation, the filter may be flushed using an "on-line" regeneration procedure with the flush liquid advantageously passing through the filter in the same direction as in normal use. The disposition of the filtrate may also be changed, depending on an operating mode of either (1) asphaltene precipitation/retention on the filter and (2) asphaltene dissolution/passage through the filter. In the former case, the filtered liquid product may be passed to downstream separation and recovery of one or more upgraded hydrocarbon products, while in the latter case the flush effluent slurry containing asphaltenes and solid particulate may be recycled to the hydroprocessing reaction zone.

Alteration of the liquid product solvent parameter may therefore be used to beneficially manage solid particulate and asphaltenes, and particularly their retention on, and/or passage through, a filter or filtration device. A suitable pore size for a filter or filtration device that is flushed using an on-line regeneration procedure or other flushing technique may be somewhat larger than the average solid particulate particle size or diameter. For example, the filter may be sized such that the majority (e.g., at least about 80%, at least about 90%, or at least about 95%) or substantially all (e.g., greater than about 99%) of the solid particulate has a smaller particle diameter than the nominal or average pore size of the filter. This is possible because the precipitation of asphaltenes in the liquid product beneficially flocculates the solid particulate into larger agglomerates that are retained on the filter, while the dissolution of asphaltenes disrupts these formed agglomerates, causing the resulting, un-agglomerated solid particulate to pass through the filter.

Processes according to the present invention therefore utilize control of a liquid product solvent parameter (i.e., the solvent blending number:insolubility ratio) to effect asphaltene precipitation/solid particulate flocculation and thereby improve filtration efficiency. The asphaltene solubilizing capability of oils is documented in the art, as well as the ability to determine how an additive such as a diluent or flush liquid, as discussed above, will affect this capability. The invention is therefore applicable to slurry processes in general, and slurry hydroprocessing in particular, which can benefit from controlling asphaltene precipitation (possibly in combination with controlling asphaltene dissolution) in order to effectively flocculate solid particulates and improve the efficiency of their separation by filtration.

Embodiments of the invention relate to the use of slurry hydroprocessing in combination with filtering of a liquid product, which is itself in the form of a slurry with a solid particulate, recovered from a slurry effluent exiting the hydroprocessing reactor or reaction zone. Generally, the liquid product is recovered as a heavier boiling fraction (i.e., having a higher initial boiling point relative to the liquid fraction of the entire slurry effluent) after flash separation and/or fractionation of the slurry effluent. Depending on the particular feedstock and desired products, these downstream separation steps may yield one or more upgraded products such as higher-value naphtha or distillate fractions resulting from cracking reactions. Other products may include gaseous products that contain hydrogen, hydrogen sulfide, and methane and other light hydrocarbons, that may be recovered as a vapor fraction from a flash separator. Often, it will be desired to separately recover a hydrogen-rich gas stream from the slurry effluent (e.g., as an overhead gas stream from a high pressure separator), which is combined with fresh make-up hydrogen used to replace hydrogen consumed in hydroprocessing and lost in any purge or vent gas streams or through dissolution in the liquid product. The combined stream may then be recycled to the hydroprocessing reactor or reaction zone.

The term "liquid product" refers to a liquid fraction of the slurry effluent, normally itself recovered in the form of a slurry in combination with the solid particulate. Filtration of the liquid product (or liquid product/solid particulate slurry) is used to obtain the solid particulate in a retentate or retained portion and a filtered liquid product in a filtrate or filtered portion. The liquid product may have a composition that is altered through the addition of a diluent and/or a flush liquid, at various addition points as discussed above, in order to change its solvent parameter or ability to solubilize asphaltenes, thereby improving the solids management of the process. The composition of the liquid product may otherwise be altered by changing one or more operating conditions and particularly the conditions under which (i) the slurry effluent is separated (e.g., by flash separation) to recover the liquid product and/or (ii) the hydroprocessing reactor or reaction zone operates to generate the slurry effluent, having a liquid fraction with a reduced molecular weight and/or reduced heteroatom (e.g., sulfur and/or nitrogen) containing impurities. Diluent and/or flush liquid addition in combination with one or more operating condition adjustments is also possible.

As discussed above, the present invention is associated with the finding that the precipitation of asphaltenes in the liquid product substantially benefits the filtration of solid particulate that is recovered together with this liquid product (e.g., in the form of a slurry of liquid product and solid particulate). The ability of the liquid product to either precipitate or solubilize asphaltenes, as discussed above, is dependent on its composition. For example, U.S. Pat. No. 5,997,723 describes liquid hydrocarbons in terms of their asphaltene solubilizing capability. This patent in particular discloses the "solubility blending number" and the "insolubility number" of asphaltene containing hydrocarbons and describes in detail the procedures, hereby incorporated by reference, for obtaining these quantities. In particular, the analyses involve testing for asphaltene precipitation as the liquid hydrocarbon is blended with varying proportions of n-heptane and toluene (which are, respectively, a non-solvent and a solvent for asphaltenes). Asphaltene precipitation is thermodynamically favored (i.e., at equilibrium) when the solubility blending number of the liquid hydrocarbon is less than its insolubility number (i.e., the liquid hydrocarbon has a solubility blending number:insolubility ratio of less than 1).

Slurry hydroprocessing methods according to the present invention therefore comprise filtering a liquid product that is recovered from the slurry effluent of a slurry hydroprocessing reactor or reaction zone, in combination with solid particulate (i.e., in the form of a slurry). As discussed above, the precipitation of asphaltenes in the liquid product facilitates the filtration of the solid particulate, possibly by causing its flocculation or agglomeration. The filtering of the liquid product therefore provides a filtration retentate comprising the precipitated, solid asphaltenes together with a retained portion of the solid particulate and optionally other solids (e.g., inorganic oxides such as sand and/or non-catalytic refractory solid materials introduced into the process). Advantageously, the filtering of the liquid product may be performed effectively using only modest filtration temperatures, for example in the range from about 80° C. (176° F.) to about 200° C. (392° F.), and often in the range from about 100° C. (212° F.) to about 150° C. (302° F.), with these temperatures being near the melting point of various heavy organic compounds that can precipitate, resulting in filtration conditions previously considered unfavorable. In a preferred embodiment, filtering of the liquid product is carried out at a temperature of at least about 5° C. (9° F.) below the softening temperature of the hydrocarbon-containing, asphaltenic material recovered in the flocculated mass (i.e., a portion of the filtration retentate that does not include the retained portion of solid particulate). The softening point is determined according to known analytic methods (ASTM D36). The effectiveness of filtering may be improved when the liquid product is agitated, or maintained in a state of agitation, prior to and/or during the filtering. In addition to the above absolute and relative temperatures, as well as the use of agitation, suitable filtration conditions also normally include a pressure drop across the filter or filtration device of at most about 2.1 MPa (300 psi), typically at most about 1.4 MPa (200 psi), and often at most about 0.7 MPa (100 psi).

Agglomerates of the solid particulate, formed in the presence of solid asphaltenes, may have a significantly larger average particle size than that of the solid particulate itself (i.e., in its un-agglomerated state, for example as a free-flowing powder), thereby improving the effectiveness of the solid/liquid separation, via filtration, of the liquid product. For example, it has been found that a filter having a nominal pore size of 30 microns can effectively filter agglomerates of a solid particulate having an average particle size of only 20 microns. Thus, a further aspect of the invention is directed to the use of use of a relatively larger pore filter, having a reduced tendency to plug and/or a longer operating life, to filter the larger agglomerates of solid particulate formed in the presence of precipitated asphaltenes. Typical nominal pore sizes of filters and filtration devices used in filtering the liquid product are in the range from about 10 microns to about 500 microns. Typical solid particulates have an average particle size or diameter in the range from about 1 micron to about 300 microns, normally in the range from about 1 to 100 microns, and often in the range from about 10 microns to about 50 microns. In representative embodiments of the invention, the nominal pore size (or rated filtration degree or other specification designating the minimum particle size or dimension to be retained) of the filter or filtration device exceeds the average particle size of the solid particulate by at least about 10%, at least about 25%, at least about 35, or at least about 50%.

In representative embodiments, in order to promote asphaltene precipitation from the liquid product/agglomeration of the solid particulate, the liquid product will have a solubility blending number that is generally less than about 1.4 times the insolubility number of the liquid product. The solubility blending number:insolubility number ratio is typically less than about 1.3, normally less than about 1.0, and often less than about 0.8 to promote the precipitation of asphaltenes prior to filtering of the liquid product. Asphaltene precipitation improves filtration efficiency, such that the filtered liquid product resulting from this filtration will generally have a solids content of less than about 10% by weight, typically less than about 5% by weight, and often less than about 1% by weight, even in cases where the nominal pore size of the filter is greater than that of the solid particulate.

After some time in its operating service of filtering the liquid product, the filter may be flushed to remove accumulated solid asphaltenes and solid particulate in the filtration retentate that can plug the filter or otherwise detrimentally affect its performance over time. According to one embodiment, the filter may be flushed on-line by adding a flush liquid that, when combined with the liquid product, alters the liquid product composition such that it has a solvent parameter of greater than 1 and solubilizes the precipitated asphaltenes, thereby disrupting the agglomerates of the solid particulate and allowing the smaller (now un-agglomerated) solid particulate to pass through the filter in the normal, forward direction of flow.

According to this embodiment, the liquid product, after mixing with the added flush liquid, therefore generally has a solubility blending number of at least about 1.4 times, typically at least about 2 times, and often at least about 3 times, its insolubility number. The solvent parameter of this mixture may be determined using the relative flow rates of the liquid product and flush liquid to prepare a representative mixture with a given ratio of these components, which is analyzed as discussed above. The flush liquid may be added at a number of possible addition points in the slurry hydroprocessing flow scheme. For example, addition may be upstream of a separator used for recovery of the liquid product from the hydroprocessing slurry effluent or otherwise direct addition to the filter or filtration device, located downstream of this separator (e.g., on the separator bottoms stream) may be used.

According to an alternative embodiment, the flush liquid can be used to "back flush" the filter by removing the accumulated retentate in the opposite direction of the normal flow of the liquid product through the filter. One option for back flushing involves alternating or swinging one or more filters between an operating (or in-service) mode and a flushing (cleaning or regeneration) mode. Otherwise, automatic cycling between periods of filtration and flushing or cleaning may be performed. Suitable automated filtration devices, for example, may alternate between (i) a filtering cycle when the pressure drop across the filter element is below a specified value and (ii) a backwashing or cleaning cycle, using flush liquid, when the pressure drop exceeds this value. Representative examples of such filtration devices include "Automatic Counterwash Refining" or ACR filters (FILTREX s.r.l, Milano San Felice, Italy). If back flushing is used, then the filtration retentate when combined with the flush liquid (i.e., the flush effluent slurry), will preferably have a solubility blending number as discussed above with respect to the liquid product (i.e., at least about 1.4 times, typically at least about 2 times, and often at least about 3 times, its insolubility number) in order to solubilize asphaltenes that are recycled back to the slurry hydroprocessing reactor or reaction zone.

Whether on-line or back flushing is employed, flushing of the filter provides a flush effluent slurry comprising the retained portion of the solid particulate (in the retentate) and also comprises dissolved or solubilized asphaltenes as a result of the increased asphaltene solubilizing capability (i.e., solvent parameter) of the flush liquid, relative to that of the liquid product. The flush effluent slurry or at least a portion thereof may be recycled to the slurry hydroprocessing reaction zone to minimize catalyst losses. With respect to recycle, the flush liquid, contained in the flush effluent slurry, will advantageously have asphaltene solubilizing capability that can reduce the tendency for asphaltene precipitation in the heavy hydrocarbon feedstock and thereby improve the overall performance (e.g., yields of one or more desired products) of slurry hydroprocessing. Recycling of the flush effluent slurry, and particularly the solubilized, carbonaceous asphaltenes contained in this slurry, may also beneficially reduce or control coking in the hydroprocessing reaction zone. If recycle of the solid particulate is employed, it will be generally required to purge at least a small amount, thereby limiting the accumulation of impurities in the process, and to replace the purged amount with fresh solid particulate (e.g., catalyst). Other than being recycled, the flush effluent slurry may be used as a feed (or incremental feed) to a gasifier or as a source of iron, carbon, and/or other metals for cement manufacturing, metallurgical processing, or other processes.

In a further representative embodiment, filtration of the slurry effluent is performed in a continuous manner using cross-filtration to continuously provide (i) the flush effluent slurry of a flush liquid and the filtration retentate comprising the precipitated asphaltenes, solid particulate (e.g., iron sulfide), and possibly other solids as discussed above, and (ii) the filtered liquid product. Continuous filtration devices include "Lamellar Self-cleaning" filters (FILTREX s.r.l, Milano San Felice, Italy) having a filtering element made of a plurality of alternating filtering disks and cleaners positioned between consecutive disks to remove impurities having dimensions corresponding to or larger than the designed filtration degree. Filtration using these and other types of filters may be accompanied by steam injection.

Representative flush liquids include refinery process streams having a high content of aromatics that can aid in the solubilization of asphaltenes. Examples include liquids derived from fluid catalytic cracking (FCC) such as light, intermediate, and heavy cycle oils. Other highly aromatic streams include straight-run or coker vacuum gas oils (VGO), or even a portion of the heavy hydrocarbon feedstock that is normally passed to the slurry hydroprocessing reactor. Typical cycle oils from FCC and other low-value, refractory streams that are not easily upgraded will generally comprise at least about 20%, and often at least about 40%, by weight of aromatics (e.g., as mono-ring or multi-ring aromatics), rendering such liquids suitable for flushing the filter. Chemical solvents such as alcohols and/or ketones may also be employed as flush liquids, alone or in combination with the use of refinery hydrocarbon streams.

The solid particulate is generally a compound of a catalytically active metal, or a metal in elemental form, either alone or supported on a refractory material such as an inorganic metal oxide (e.g., alumina, silica, titania, zirconia, and mixtures thereof). Other suitable refractory materials are include carbon, coal, and clays. Zeolites and non-zeolitic molecular sieves are also useful as solid supports. One advantage of using a support is its ability to act as a "coke getter" or adsorbent of asphaltene precursors that might otherwise lead to fouling of process equipment.

Catalytically active metals for use in hydroprocessing include those from Group IVB, Group VB, Group VIB, Group VIIB, or Group VIII of the Periodic Table, which are incorporated in the heavy hydrocarbon feedstock in amounts effective for catalyzing desired hydrotreating and/or hydrocracking reactions to provide, for example, lower boiling hydrocarbons that may be fractionated from the hydroprocessing slurry effluent as naphtha and/or distillate products in the substantial absence of the solid particulate. Representative metals include iron, nickel, molybdenum, vanadium, tungsten, cobalt, ruthenium, and mixtures thereof. The catalytically active metal may be present as a solid particulate in elemental form or as an organic compound or an inorganic compound such as a sulfide (e.g., iron sulfide) or other ionic compound. Metal or metal compound nanoaggregates may also be used to form the solid particulates.

Often, it is desired to form such metal compounds, as solid particulates, in situ from a catalyst precursor such as a metal sulfate (e.g., iron sulfate monohydrate) that decomposes or reacts in the hydroprocessing reaction zone environment, or in a pretreatment step, to form a desired, well-dispersed and catalytically active solid particulate (e.g., as iron sulfide). Precursors also include oil-soluble organometallic compounds containing the catalytically active metal of interest that thermally decompose to form the solid particulate (e.g., iron sulfide) having catalytic activity. Such compounds are generally highly dispersible in the heavy hydrocarbon feedstock and normally convert under pretreatment or hydroprocessing reaction zone conditions to the solid particulate that is contained in the slurry effluent. An exemplary in situ solid particulate preparation, involving pretreating the heavy hydrocarbon feedstock and precursors of the ultimately desired metal compound, is described, for example, in U.S. Pat. No. 5,474,977.

Other suitable precursors include metal oxides that may be converted to catalytically active (or more catalytically active) compounds such as metal sulfides. In a particular embodiment, a metal oxide containing mineral may be used as a precursor of a solid particulate comprising the catalytically active metal (e.g., iron sulfide) on an inorganic refractory metal oxide support (e.g., alumina). Bauxite represents a particular precursor in which conversion of iron oxide crystals contained in this mineral provides an iron sulfide catalyst as a solid particulate, whereby the iron sulfide after conversion being supported on the alumina that is predominantly present in the bauxite precursor.

Representative heavy hydrocarbon feedstocks to the slurry hydroprocessing reactor or reaction zone are a combination of a fresh hydrocarbon feed and a hydrocarbon recycle. Suitable fresh hydrocarbon feeds include asphaltene containing hydrocarbon fractions obtained from the distillation of crude oil, such as hydrocarbon residues (or resids) or gas oils from atmospheric column or vacuum column distillation. Other fresh hydrocarbon feeds that may benefit from slurry hydroprocessing (e.g., to decrease the overall molecular weight of the heavy hydrocarbon feedstock, and/or remove organic sulfur and nitrogen compounds and metals) include the high-boiling process streams (i.e., heavy hydrocarbon products) obtained after such hydrocarbon distillation residues (e.g., atmospheric or vacuum column residues) have undergone thermal or catalytic conversion. Such streams include cycle oils and slurry oils obtained from fluid catalytic cracking (FCC), coker gas oils (e.g., obtained from a delayed coker or a fluidized coker), visbreaker gas oils, and other materials containing asphaltenes. The heavy hydrocarbon feedstock may also comprise, as a fresh hydrocarbon feed (or feed component or incremental feed), whole or topped petroleum crude oils, bitumen or oils sands (e.g., Canadian oil sands), biomass derived oils, waste-derived synthetic oils, coal-derived oils (e.g., from coal liquefaction), tars, and shale oils. Combinations of any of these fresh hydrocarbon feeds may also be used.

In addition to the fresh hydrocarbon feed, the heavy hydrocarbon feedstock that is passed as a slurry (i.e., in combination with the solid particulate) through the reaction zone will often comprise a hydrocarbon recycle, and in particular the flush effluent slurry, as discussed above. The flush effluent slurry is generated from flushing the filter to remove the filtration retentate and will therefore comprise asphaltenes, a retained portion of the solid particulate (e.g., iron sulfide), and possibly other solid materials (e.g., sand or other refractory metal oxide components that may act to absorb asphaltene precursors). In general, the heavy hydrocarbon feedstock, which may be a mixture of a recycled flush effluent slurry and a fresh hydrocarbon feed as described above (e.g., a vacuum distillation column resid) will have an initial boiling point, or distillation "front-end," temperature of greater than about 343° C. (650° F.), which is representative of atmospheric column resides that are normally further fractionated and/or converted in refineries to provide gas oils.

In addition to asphaltenes, the heavy hydrocarbon feedstock generally also contains metallic contaminants (e.g., nickel, iron and vanadium), a high content of organic sulfur and nitrogen compounds, and a high Conradson carbon residue. The metals content, for example, may be 100 ppm to 1,000 ppm by weight, the total sulfur content may range from 1% to 7% by weight, and the API gravity may range from about −5° to about 35°. The Conradson carbon residue of the heavy hydrocarbon feedstock is generally at least about 5%, and is often from about 10% to about 30% by weight. Advantageously, slurry hydroprocessing as described herein can be used to upgrade many heavy hydrocarbon feedstock components (e.g., coker gas oils), having properties that render them detrimental to other types of catalytic conversion processes such as hydrocracking and fluid catalytic cracking.

Slurry hydroprocessing methods for preparing one or more upgraded hydrocarbon products such as distillate hydrocarbons generally involve passing the heavy hydrocarbon feedstock and solid particulate, as described above, through a slurry hydroprocessing reaction zone in the presence of hydrogen to provide a slurry effluent. The heavy hydrocarbon feedstock is normally passed upwardly through the reaction zone, with the slurry of this feedstock and solid particulate generally having a solids content in the range from about 0.01% to about 10% by weight. According to some embodiments, the heavy hydrocarbon feedstock may be combined with a well-dispersed homogeneous (e.g., oil soluble) catalyst precursor that forms solid particulate under conditions in the reaction zone. The slurry hydroprocessing reaction(s) (e.g., hydrotreating and/or hydrocracking) is/are typically carried out in the presence of a combined recycle gas containing hydrogen, that is a mixture of a hydrogen-rich gas stream, recovered from the slurry effluent (e.g., as an overhead gas stream from a high pressure separator) and fresh make-up hydrogen that is used to replace hydrogen consumed in the hydroprocessing reactor or reaction zone and lost in any purge or vent gas streams or through dissolution. Operation without hydrogen recycle (i.e., with "once-through" hydrogen) represents an alternative mode of operation, in which a number of possible hydrogen sources of varying purity may be used.

Often, slurry hydroprocessing is carried out using reactor or reaction zone conditions sufficient to crack at least a portion of the heavy hydrocarbon feedstock to lower-boiling products such as distillate hydrocarbon, naphtha, and/or light end (e.g., $C_1$-$C_4$ hydrocarbon) products that are also recovered from the slurry effluent, usually downstream of the recovery of the hydrogen-rich gas stream from this effluent. Conditions in the slurry hydroprocessing reactor or reaction zone generally include a temperature from about 343° C. (650° F.) to about 538° C. (1000° F.), a hydrogen partial pressure from about 3.5 MPa (500 psig) to about 21 MPa (1500 psig), and a space velocity from about 0.1 to about 30 volumes of heavy hydrocarbon feedstock per hour per reactor or reaction zone volume. Representative processes involve the recovery of at least one gaseous product, such as a light end product, from a downstream single-stage or flash separation of the slurry effluent.

Other products, including the lower-boiling naphtha and/or distillate hydrocarbon products, may be recovered by fractionation of the filtered liquid product that is obtained by filtering of the bottoms fraction or liquid product from the flash separation. A distillate hydrocarbon product generally refers to a hydrocarbon fraction having a distillation end point which is above that of naphtha. A distillate hydrocarbon product, for example, may be recovered as a fraction having a distillation end point temperature typically in the range from about 204° C. (400° F.) to about 399° C. (750° F.), and often from about 260° C. (500° F.) to about 343° C. (650° F.). According to representative embodiments of the invention, the yield of one or a combination of distillate hydrocarbon products from slurry hydroprocessing (having a distillation end point in these ranges), is generally at least about 20% by weight (e.g., from about 20% to about 65% by weight), and normally at least about 30% by weight (e.g., from about 30% to about 50% by weight), based on the weight of the filtered liquid product that is sent to downstream fractionation.

Depending on the desired end products, the distillate hydrocarbon product may itself be fractionated to yield, for example, naphtha and diesel fuel having varying distillation end point temperatures. For example, a relatively light naphtha may be separated, having a distillation end point temperature from about 175° C. (347° F.) to about 193° C. (380° F.). According to other embodiments, a relatively heavy naphtha may be separated from the distillate hydrocarbon product, having a distillation end point temperature from about 193° C. (380° F.) to about 204° C. (400° F.). The naphtha may be fractionated into one or more naphtha fractions, for example light naphtha, gasoline, and heavy naphtha, with representative distillation end points being in the ranges from about 138° C. (280° F.) to about 160° C. (320° F.), from about 168° C. (335° F.) to about 191° C. (375° F.), and from about 193° C. (380° F.) to about 216° C. (420° F.), respectively.

The present invention therefore relates to overall methods for upgrading heavy hydrocarbon feedstocks and particularly hydrocarbon distillation residues, which exploit the surprising discovery that the control of asphaltene precipitation allows for greatly improved solids management. Liquid products recovered (e.g., in the form of a slurry) from slurry hydroprocessing reactor effluents can therefore be efficiently filtered in the presence of precipitated asphaltenes, believed to act as flocculants of the solid particulate. This filtering therefore provides a retentate comprising a retained fraction of the solid particulate in combination with asphaltenes and a filtered liquid product having a reduced content of the solid particulate, relative to the liquid product recovered as a slurry in combination with the solid particulate (i.e., upstream or prior to the filtering). Generally, the solids removal efficiency from this liquid product will exceed about 90% (i.e., filtering removes at least about 90%, typically at least about 95%, and often at least about 99%, of the solids present in the liquid product). Advantageously, this removal efficiency may be achieved using a filter having a nominal or average pore size that exceeds the average particle size of the solid particulate, due to the formation of agglomerates of the solid particulate in the presence of precipitated asphaltenes. The use of larger pore filtration devices can extend operating life and reduce the pressure drop across the filter.

Those having skill in the art will recognize that the improvements in filtration and solids management described herein will in general provide significant commercial advantages in a wide range of applications involving solids recovery from asphaltene containing liquid products. The control of asphaltene precipitation effectively allows such liquid products to be filtered in a manner whereby precipitated asphaltenes are selectively retained with the solid particulate in a filtration retentate. The separated retentate and filtered liquid product may then, for example, be respectively recycled to a reaction zone and fractionated into hydrocarbon products.

A representative process flowscheme illustrating a particular embodiment for carrying out the slurry hydroprocessing methods described above is depicted in FIG. 1. FIG. 1 is to be understood to present an illustration of the invention and/or principles involved without limiting the scope of the appended claims in any way. As is readily apparent to one of skill in the art having knowledge of the present disclosure, methods according to various other embodiments of the invention will have configurations, components, and operating parameters determined, in part, by specific feedstocks, products, and product quality specifications.

According to the embodiment illustrated in FIG. 1, a slurry 1 of a heavy hydrocarbon feedstock (e.g., vacuum distillation column residue as a fresh hydrocarbon feed 5 in combination with a hydrocarbon recycle, namely flush effluent slurry 13) and a solid particulate catalyst or precursor (e.g., iron sulfate monohydrate) is discharged from holding tank 30 used to circulate this slurry under elevated temperature, for example about 150° C. (302° F.). Solid particulate is supplied from reservoir 20 and introduced as fresh material to holding tank 30, together with fresh hydrocarbon feed 5, as needed. Slurry 1 is combined with recycle gas 2 containing hydrogen, prior to the combined feed 4 being heated with heater 40 and passed to slurry hydroprocessing reactor or reaction zone 50.

Recycle gas 2 is a mixture of fresh make-up hydrogen 7 and portion 3*a* of hydrogen-rich gas 3. Fresh make-up hydrogen 7 is used to replace hydrogen consumed in slurry hydroprocessing reaction zone 50 and lost through dissolution and in purge 3*b* of hydrogen-rich gas 3 that is recovered from slurry effluent 6 as overhead gas stream 14 from high pressure separator 60. In addition to hydrogen-rich gas 3, light ends product 8, containing light hydrocarbons with relatively low polarity, may also be recovered from overhead gas stream 14 exiting high pressure separator 60. A conventional separation and heat exchange section 80 may be used to recover hydrogen-rich gas 3 and light ends product 8, as well as inorganic, light byproducts 15 of hydroprocessing, which include $H_2S$, $NH_3$, and $H_2O$.

Liquid product in the form of a slurry 9, exiting the bottoms of high pressure separator 60 and containing solid particulate, is then passed to filter or filtration device 70 used to separate filtered liquid product 10 from a filtration retentate comprising precipitated asphaltenes and the solid particulate (or a retained portion thereof). As discussed above, operational parameters such as the conditions in the slurry hydroprocessing reaction zone 50 and high pressure separator 60 can be varied to control the polarity of the liquid product and consequently its ability to solubilize asphaltenes contained therein. According to one embodiment, the temperature used in high pressure separator 60 is adjusted to vary the degree to which lighter, non-polar hydrocarbons either report to light ends product 8, comprising relatively low molecular weight hydrocarbons, or condense into filtered liquid product 10, comprising relatively high molecular weigh hydrocarbons. Lower separation temperatures, which directionally favor condensation, result in decreased polarity of the liquid product prior to filtration and consequently a greater tendency for asphaltenes to precipitate.

According to other embodiments, the composition and polarity of the liquid product can be controlled by adding a diluent and/or a flush liquid. As illustrated in FIG. 1, flush liquid 11 is added directly to filter or filtration device 70 continuously or intermittently to remove and recycle the filtration retentate as flush effluent slurry 13 back to holding tank 30 and ultimately hydroprocessing reaction zone 50. Flush liquid 11 preferably aids in the resolubilization of asphaltenes in the filtration retentate. Overall, the polarity and asphaltene solubilizing capability of the liquid product recovered as a slurry 9 from the slurry hydroprocessing effluent 6 may be modified using a diluent or a flush liquid, as discussed above, to precipitate or solubilize asphaltenes, respectively. Diluent or flush liquid, for example, may be introduced as an addition stream 12 upstream of high pressure separator 60. Alternatively, diluent and/or flush liquid may be introduced to holding tank 30, to high pressure separator 60, to slurry 9 comprising the liquid product, prior to filtration, or to various other diluent or flush liquid addition points in the process.

As is apparent from this description, overall aspects of the invention are directed to processes in which solid recovery from asphaltene containing hydrocarbon streams is facilitated by control of asphaltene precipitation. In view of the present disclosure, it will be seen that several advantages may be achieved and other advantageous results may be obtained. Also, it will be appreciated that various changes could be made in the above processes without departing from the scope of the present disclosure. Those having skill in the art will recognize the applicability of the methods disclosed herein to any of a number of processes, including those involving slurry hydroprocessing.

The following examples are set forth as representative of the present invention. These examples are not to be construed as limiting the scope of the invention as these and other equivalent embodiments will be apparent in view of the present disclosure and appended claims.

EXAMPLE 1

A bench test verified that a flocculated solid particulate, from a representative liquid product of slurry hydroprocessing, was effectively filtered (or retained in a filtration retentate) using only a modest pressure drop of less than 200 psi to achieve nearly complete filtration at a cake thicknesses in excess of 0.125 to 0.25 inch. This was demonstrated using relatively low filtration temperatures in the range from 80° C. (176° F.) to 200° C. (392° F.).

Without being bound by theory, this experiment provided evidence that sufficient dispersal of the catalyst agglomerates was maintained to allow good cake permeability and reasonably low cake compressibility. According to Darcy's law, the pressure drop across the cake deposited on a filter is determined from the relationship $\Delta P = Q\mu\theta/(KA)$, where $\Delta P$=pressure drop, Q=flow rate, $\mu$=fluid viscosity, $\theta$=thickness, K=filter area, and A=permeability factor.

Thus, it was determined that the hydrocarbons that can be precipitated from the slurry hydroprocessing reactor or reaction zone effluent formed relatively higher melting and non-deformable agglomerates, creating a cake of good permeability that was easily filtered. According to aspects of the invention, this discovery allows the circumvention of expensive and impractical filtration equipment, by exploiting the solubility differences among hydrocarbons that are formed in the slurry hydroprocessing liquid product.

EXAMPLE 2

In a pilot plant test, a non-agitated vessel was used to receive the high pressure separator underflow or bottoms from the effluent of a slurry hydrocracking process, which was flashed to recover light gases. The vessel was maintained at 200° C. (392° F.). A mass of hydrocarbon and catalyst formed at the lower portions of this vessel, requiring some mechanical force to remove. In a second test, the vessel was circulated to allow the flocculated solids to maintain a suspension. If was found that the solids could be more easily filtered. It was expected that the cake could be removed using moderate force, such as normal backwashing. The solid mass, after washing with toluene to remove the associated oil, was found to have a softening point (ASTM D36) of greater than 200° C. (392° F.) and the onset of melting, as measured by thermomechanical analysis was also above 200° C. (392° F.).

The invention claimed is:

1. A slurry hydroprocessing method comprising:

(a) passing a slurry comprising a heavy hydrocarbon feedstock containing asphaltenes and a solid particulate through a reaction zone to provide a slurry effluent;

(b) filtering a liquid product through a filter, recovered from the slurry effluent in combination with the solid particulate, to provide a filtration retentate comprising precipitated asphaltenes and further comprising a retained portion of the solid particulate;

(c) recycling the filtration retentate to the reaction zone;

(d) the liquid product has a solubility blending number : insolubility number ratio that is less than about 1.4; and wherein the filter has a pore size exceeding the average particle size of the solid particulate.

2. The method of claim 1, wherein both the liquid product and at least one gaseous product are recovered from the slurry effluent by flash separation.

3. The method of claim 1, wherein step (b) provides a filtered liquid product having a solids content of less than about 4% by weight.

4. The method of claim 1, wherein the solid particulate comprises a compound of a metal of Group IVB, Group VB, Group VIB, Group VIIB, or Group VIII.

5. The method of claim 4, wherein the solid particulate comprises an iron-containing catalyst precursor.

6. The method of claim 1, wherein the solid particulate has an average particle size from about 1 micron to about 100 microns.

7. The method of claim 1, wherein the heavy hydrocarbon feedstock comprises a component selected from the group consisting of (i) an atmospheric column residue or a vacuum column residue obtained from the distillation of crude oil; (ii) a heavy hydrocarbon product obtained from thermally or catalytically cracking of (i); (ii) bitumen; (iii) Canadian oil sands; (iv) a biomass derived oil, (v) a waste-derived synthetic oil, (vi) a coal-derived oil; and (vii) blends thereof.

8. The method of claim 7, wherein the heavy hydrocarbon feedstock has an initial boiling point of greater than about 343° C. (650° F.).

9. The method of claim 1 further comprising (c) flushing a filter, for filtering the liquid product, with a flush liquid to provide a flush effluent slurry comprising the solid particulate.

10. The method of claim 9, wherein the flush effluent slurry has a solubility blending number : insolubility number ratio of at least about 1.4.

11. The method of claim 9, wherein the flush liquid is added to the filter or to the liquid product, downstream of a separator used to recover the liquid product from the slurry effluent.

12. The method of claim 9, wherein the flush liquid comprises at least about 40% by weight of aromatics.

13. The method of claim 12, wherein the flush liquid is derived from fluid catalytic cracking.

14. The method of claim 9, further comprising recycling at least a portion of the flush effluent slurry to the reaction zone.

15. The method of claim 1, wherein the reaction zone is maintained at a temperature from about 343° C. (650° F.) to about 593° C. (1100° F.), a hydrogen partial pressure from about 3.5 MPa (500 psig) to about 21 MPa (3000 psig), and a space velocity from about 0.1 to about 30 volumes of heavy hydrocarbon feedstock per hour per volume of the reaction zone.

16. A method for upgrading a hydrocarbon distillation residue, the method comprising:

(a) passing a slurry comprising the hydrocarbon distillation residue and a solid particulate through hydroprocessing reaction zone in the presence of hydrogen to provide a slurry effluent, wherein the hydrocarbon distillation residue contains asphaltenes, (b) subjecting the slurry effluent to one or more flash separation or distillation stages to recover a liquid product in combination with the solid particulate, (c) filtering the liquid product through a filter to provide (i) a filtered liquid product having a reduced content of both the solid particulate and asphaltenes and (ii) a retentate comprising a retained fraction of the solid particulate and asphaltenes;

(d) continuously or periodically flushing the filter with a flush liquid to provide a flush effluent slurry comprising the retained fraction of the solid particulate and the asphaltenes;

(e) recycling the retentate to the reaction zone;

wherein the liquid product has a solubility blending number: insolubility number ratio that is less than about 1.4; and wherein the filter has a pore size exceeding the average particle size of the solid particulate.

17. The method of claim 16, further comprising:

(f) recycling at least a portion of the flush effluent slurry to the hydroprocessing reaction zone.

18. The method of claim 1 wherein the liquid product has a solubility blending number : insolubility number ratio that is less than about 1.4 obtained by adding a diluent to the liquid product.

* * * * *